US005394850A

United States Patent [19]

Murphy et al.

[11] Patent Number: 5,394,850

[45] Date of Patent: Mar. 7, 1995

[54] TOP-FEED FUEL INJECTOR MOUNTING IN AN INTEGRATED AIR-FUEL SYSTEM

[75] Inventors: Kevin A. Murphy, Sterling Heights; Alan R. Taylor, Clarkston; Henry C. Dozier, Troy, all of Mich.

[73] Assignee: Siemens Electric Limited, Chatham, Canada

[21] Appl. No.: 155,982

[22] Filed: Nov. 19, 1993

[51] Int. Cl.[6] ..... F02M 55/02

[52] U.S. Cl. ..... 123/470; 285/349

[58] Field of Search ..... 123/456, 468, 469, 470, 123/472; 285/302, 349

[56] References Cited

U.S. PATENT DOCUMENTS

| | | | |
|---|---|---|---|
| 2,738,992 | 3/1956 | Heisler | 285/349 |
| 3,149,861 | 9/1964 | Larsson | 285/349 |
| 3,930,483 | 1/1976 | Blisko et al. | 123/456 |
| 4,160,625 | 7/1979 | Dyhr et al. | 285/302 |
| 4,205,637 | 6/1980 | Ito et al. | 123/456 |
| 4,519,371 | 5/1985 | Nagase et al. | 123/470 |
| 4,570,602 | 2/1986 | Atkins et al. | 123/456 |
| 4,693,223 | 9/1987 | Eshleman et al. | 123/470 |
| 4,909,221 | 3/1990 | Heuser | 123/470 |
| 4,971,014 | 11/1990 | Usui | 123/470 |
| 5,044,340 | 9/1991 | Robnett | 123/470 |
| 5,074,269 | 12/1991 | Herbon et al. | 123/456 |
| 5,170,766 | 12/1992 | Haas et al. | 123/531 |
| 5,172,939 | 12/1992 | Hashimoto | 285/24 |

*Primary Examiner*—E. Rollins Cross
*Assistant Examiner*—Thomas N. Moulis
*Attorney, Agent, or Firm*—Russel C. Wells; George L. Boller

[57] ABSTRACT

A rigid connector tube telescopically engages the fuel rail and the inlet of a top-feed fuel injector. Various embodiments of such connector tubes are disclosed. Such connector tubes enable a top-feed fuel injector to be used in an integrated air-fuel system where a fuel rail is integrally formed with a manifold such that the fuel supply ports of the fuel rail are in fixed spatial relation to the fuel injection ports of the manifold.

29 Claims, 4 Drawing Sheets

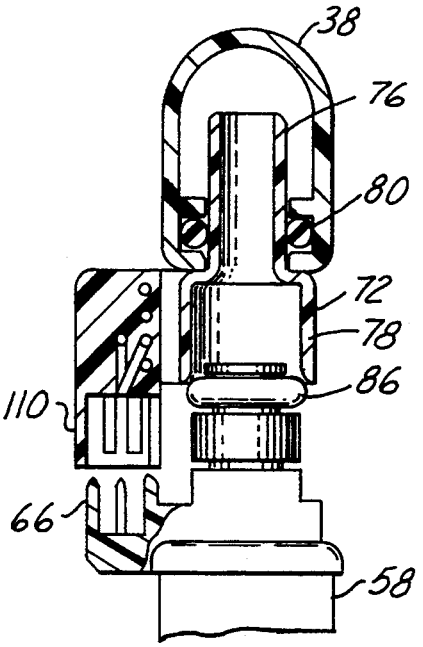
FIG.14
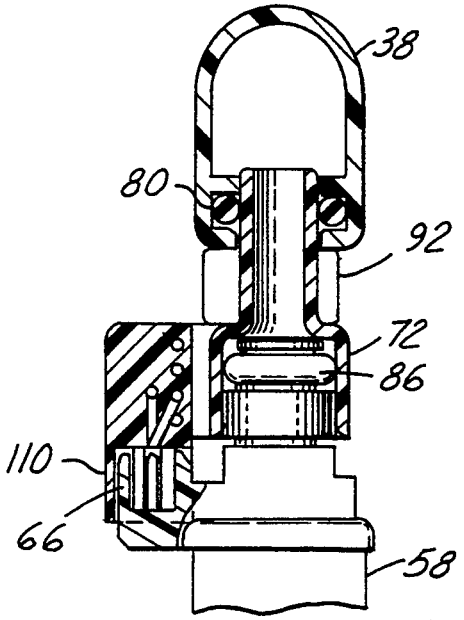
FIG.15
FIG.16
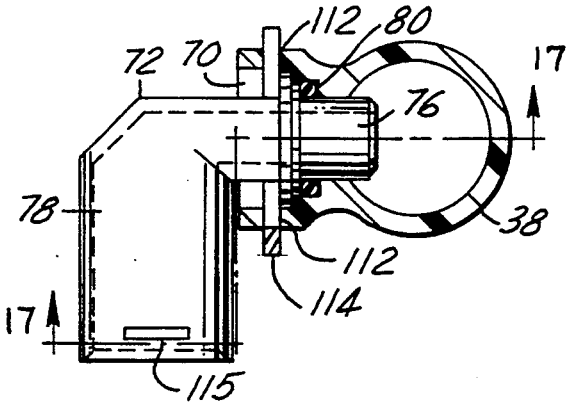
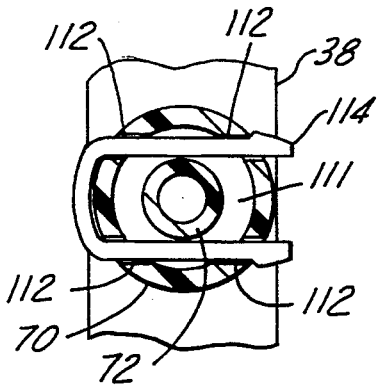
FIG.18
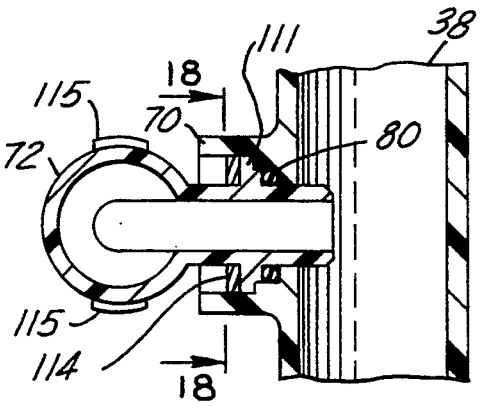
FIG.17

TOP-FEED FUEL INJECTOR MOUNTING IN AN INTEGRATED AIR-FUEL SYSTEM

FIELD OF THE INVENTION

This invention relates generally to air-fuel systems for internal combustion engines, and particularly to the mounting of top-feed fuel injectors in integrated air-fuel systems, although certain inventive principles may enjoy application in air-fuel systems that might not be classified as integrated air-fuel systems.

BACKGROUND AND SUMMARY OF THE INVENTION

The integration of air and fuel systems can provide certain advantages for the manufacturers of automotive vehicles that use internal combustion engines as their powerplants. One important advantage is that the OEM can purchase from a supplier an integrated air-fuel system which is fully ready to be installed as a unit on an engine.

The adaptation of certain manufacturing technologies to the fabrication of an integrated air induction manifold-fuel rail for an integrated air-fuel system has enabled the number of separate parts of such a system to be significantly reduced. But such economy in fabrication has been at the expense of limiting usage to what are commonly referred to as bottom-feed fuel injectors. Heretofore, it has not been possible to incorporate top-feed fuel injectors in an integrated air induction manifold-fuel rail. The present invention enables this limitation to be overcome so that it now becomes possible to use top-feed fuel injectors in an integrated air induction manifold-fuel rail.

Briefly, the ability to use top-feed fuel injectors in an integrated air induction manifold-fuel rail is achieved by making the distance from a fuel outlet port of the fuel rail to a fuel injection port of the induction air system greater than the axial length of a top-feed fuel injector as measured from the entrance of the injector's fuel inlet tube to the tip of the injector's nozzle, and telescopically mounting a rigid connector tube on one of these two ports for positioning to a telescopically retracted position that allows the fuel injector to be disposed between the connector tube and the other of these two ports for installation and removal of the fuel injector and to a telescopically extended position that captures the fuel injector in installed position between the connector tube and the other of the two ports. In the telescopically extended position of the connector tube, it telescopes over the entrance end of the fuel injector inlet tube to form a fluid-tight joint while its telescopic engagement with the one port is maintained as another fluid-tight joint.

Once a fuel injector has been installed and captured, a clip may be used to assure and maintain a desired orientation of the fuel injector and/or prevent retraction of the connector tube. It is also possible to establish electric connection of a fuel injector with an injector operating circuit concurrent with the telescopic extension of the connector tube by providing on the connector tube an electrical connector that comes into mating engagement with a matching electrical connector on the fuel injector as the connector tube is being telescopically extended. Another advantage provided by the invention is that fuel injectors may be serviced on an individual basis, thereby avoiding breaking of the seals of other fuel injectors not requiring service that would heretofore have been the case for a system having a separably attached fuel rail that required removal of the entire fuel rail even if only a single fuel injector required service.

Certain features of the invention may also have general application in air-fuel systems that are not integrated air-fuel systems.

The inventive principles will be disclosed in the ensuing description and claims, which are accompanied by drawings illustrating a presently preferred embodiment of the invention according to the best mode presently contemplated for carrying out the invention. In the various drawing Figs., like reference numerals are used to designate corresponding parts.

BRIEF DESCRIPTION OF THE DRAWINGS

FIG. 14 is a view in the same direction as FIG. 2 showing the sixth modified form.

FIG. 15 is a view in the same direction as FIG. 3 showing the sixth modified form.

FIG. 16 is a view in the same direction as FIG. 2 showing a seventh modified form.

FIG. 17 is a cross-sectional view taken in the direction of arrows 17—17 in FIG. 16.

FIG. 18 is a cross-sectional view taken in the direction of arrows 18—18 in FIG. 17.

DESCRIPTION OF THE PREFERRED EMBODIMENT

Figure 1:
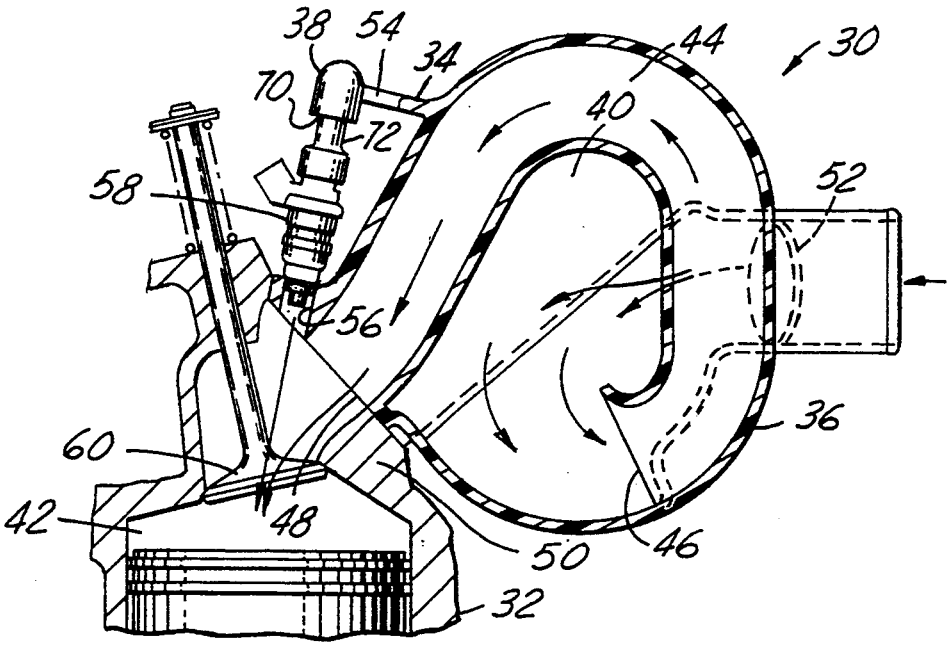
FIG. 1 is a transverse cross-sectional view through an integrated air-fuel system embodying principles of the invention, including a portion of an engine on which the integrated air-fuel system is mounted.

FIG. 1 shows a representative integrated air-fuel system 30, embodying principles of the invention, on an internal combustion engine 32. System 30 comprises an integrated air induction manifold-fuel rail 34, which is a single part consisting of a manifold 36 and a fuel rail 38. This part can be fabricated by known technologies such as lost-core molding. Manifold 36 comprises a plenum 40 that serves the engine's combustion chambers 42 via a number of runners 44. Each runner 44 forms a segment of an induction passage leading to a corresponding combustion chamber, having an entrance 46 at plenum 40 and an exit 48 at the engine's cylinder head 50. The flow of induction air into plenum 40 is under the control of a throttle 52. Fuel rail 38 parallels the length of engine 32, spanning runners 44 on the exterior of manifold 36 somewhat proximate exits 48 and integrally joining with each runner via a bridge 54. Proximate each exit 48 is a fuel injection port 56 where fuel from a fuel injector 58 is injected into a continuation of the induction passage that extends from the runner to an intake valve 60 of combustion chamber 42.

Figure 3:
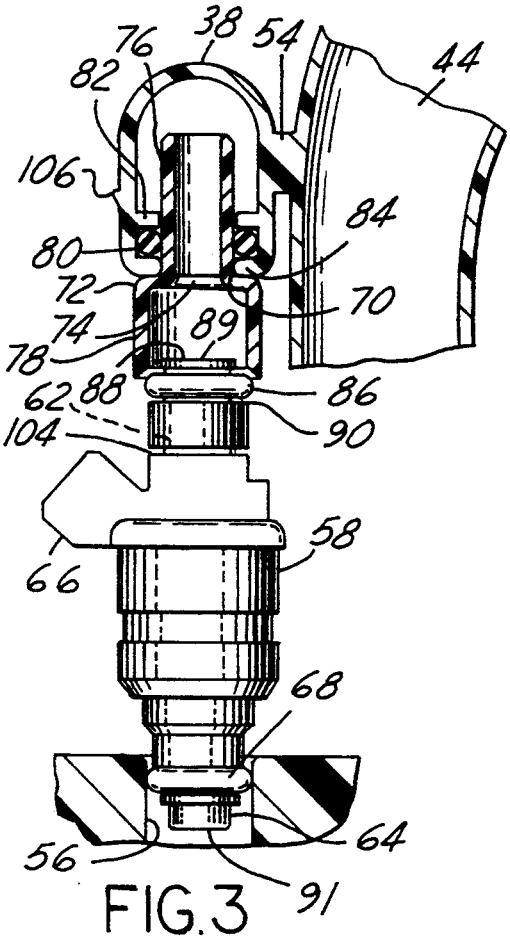
FIG. 3 is a view like FIG. 2, but showing a condition for allowing the fuel injector to be installed or removed.
Figure 2:
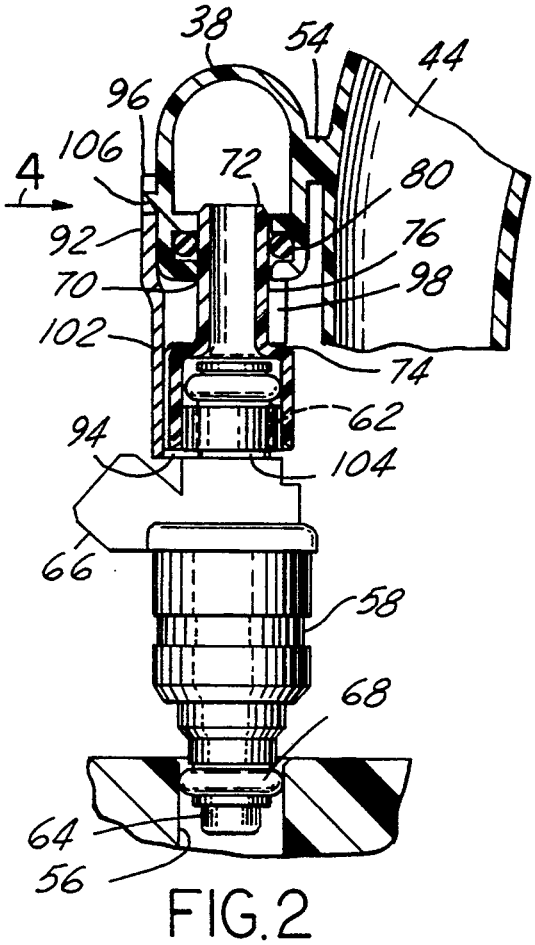
FIG. 2 is an enlarged view of a portion of FIG. 1, particularly showing a top-feed fuel injector mounting.
Figure 6:
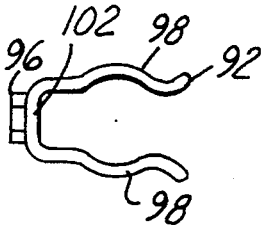
FIG. 6 is a top plan view of FIG. 5.
Figure 5:
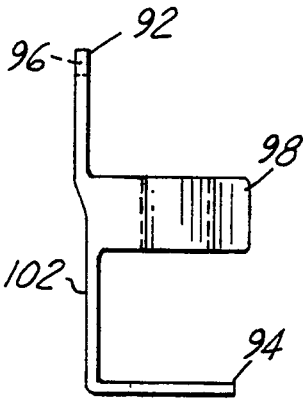
FIG. 5 is a side elevational view of a retention clip that appears in FIG. 4, FIG. 5 showing the retention clip by itself on an enlarged scale.
Figure 9:
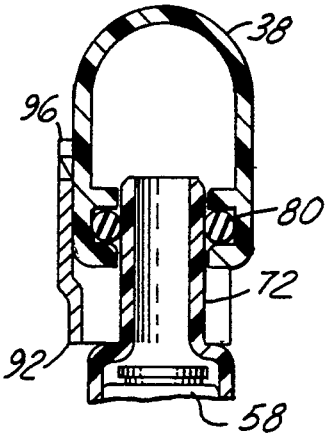
FIG. 9 is a cross-sectional view similar to FIG. 5 showing a second modified form in association with a fuel rail.
Figure 4:
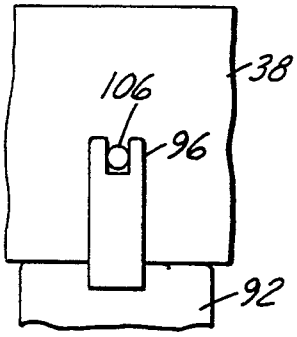
FIG. 4 is a fragmentary view in the direction of arrow 4 in FIG. 2.

Referring now also to FIGS. 2–4, fuel injector 58 is a conventional top-feed, electrically operated device, comprising a fuel inlet tube 62 at the top of its body and a nozzle 64 at the bottom of its body. On the side of the fuel injector body is an electrical connector 66 that serves to connect with a mating electrical connector (not shown) leading to a fuel injector control circuit (also not shown) that operates to cause the fuel injector to open and close in properly timed relation to the opening and closing of intake valve 60.

Nozzle 64 is seated in fuel injection port 56, and an O-ring seal 68 that extends around the outside diameter (O.D.) of the nozzle seals to the inside diameter (I.D.) of port 56.

Fuel rail 38 comprises a fuel supply port 70, and a connector tube 72 fluid-connects port 70 with the fuel injector's fuel inlet tube 62. Connector tube 72 comprises a shoulder 74 that divides the tube into a smaller diameter portion 76 and a larger diameter portion 78. Portion 76 is telescopically engaged with supply port 70 via a sealed joint while portion 76 is telescopically engaged with inlet tube 62 also via a sealed joint. The sealed joint between portion 76 and supply port 70 comprises an O-ring seal 80 that is captured on supply port 70 between spaced apart flanges, or shoulders, 82, 84. Portion 76 telescopes within the inside of supply port 70, the O.D. of portion 76 sealing to the I.D. of seal 80. The sealed joint between portion 78 and inlet tube 62 comprises an O-ring seal 86 that is captured on inlet tube 62 between shoulders 88, 90. Portion 78 telescopes over the outside of inlet tube 62, the I.D. of portion 78 sealing to the O.D. of seal 86. In this way, pressurized fuel in fuel rail 38 is communicated to inlet tube 62 of fuel injector 58 without external leakage, and fuel is injected from nozzle 64 into the induction passage without leakage.

The telescopic engagements of connector tube 72 with both fuel supply port 70 and inlet tube 62 enables the fuel injector to be installed and removed. FIG. 2 shows the installed position, as just described, wherein connector tube 72 may be said to be in one position. FIG. 3 shows another position to which connector tube 72 is positioned for installation or removal of the fuel injector. The FIG. 3 position shows tube 72 telescopically retracted into supply port 70 to an extent that breaks the telescopic engagement of tube 72 with inlet tube 62 sufficient to allow the top of the fuel injector to be tipped to the side so as to clear the larger diameter portion of tube 72, at which point the nozzle end of the fuel injector can be pulled out of injection port 56. Installation of a fuel injector is accomplished in reverse order.

Connector tube 72 allows a top-feed fuel injector to be used in an air-fuel system like that described where fuel supply port 70 and fuel injection port 56 are in fixed spatial relation to each other, and the spacing distance between them is greater than the length of the fuel injector, as measured from the entrance 89 of inlet tube 62 to the tip end 91 of nozzle 64. The ability of tube 72 to move telescopically along the O-ring seals may be enhanced by application of suitable lubricant that does not impair the sealing of the O-rings. Connector tube 72, like part 34, is preferably a fuel-compatible plastic, such as glass-filled amide or polyamide.

When the fuel injector has been installed, as depicted by FIG. 3, it is desirable to install a retention clip, such a clip 92 shown in FIGS. 4–7. (The clip does not appear in FIG. 1 so that the extended connector tube 72 can be clearly seen.) Clip 92 comprises an injector-engaging portion 94, a fuel-rail-engaging portion 96, and a spacer-snap portion 98 all three of which are joined together through a bar 102 extending along one side. Portion 94 is shaped to fit to a circumferentially keyed slot 104 in the fuel injector (FIG. 2) to relatively circumferentially locate the two, and it may have a self-retention capability that keeps the clip in place. Portion 96 is shaped to fit to an external projection 106 on fuel rail 38 proximate supply port 70 for circumferentially locating clip 92 relative to the supply port. Clip 92 thus serves, when installed, to circumferentially locate the fuel injector relative to the fuel supply port. Such circumferential locating is important when the fuel injector exhibits other than an axially symmetric spray pattern. Spacer-snap portion 98 snaps over the exposed segment of smaller diameter portion 76 to retain clip 92 installed, and this self-retention capability will be independent of any self-retention capability that may be provided by portion 94. By making the axial dimension of spacer-snap portion 98 just slightly less than the length of the exposed segment of smaller diameter portion 76, it also functions as a spacer which creates an interference between the fuel rail and connector tube 72 that prevents the connector tube from being retracted into fuel supply port 70. Thus, clip 92 performs two separate functions. Any particular clip may be metal or non-metal.

Figure 8:
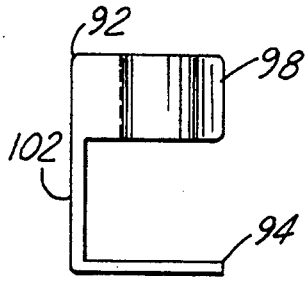
FIG. 8 is a view similar to FIG. 5 showing a first modified form.
Figure 7:
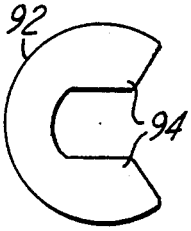
FIG. 7 is a bottom plan view of FIG. 5.
Figure 10:
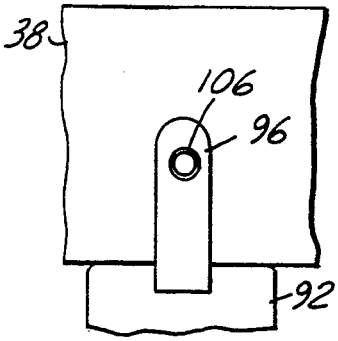
FIG. 10 is a view similar to FIG. 4 showing a third modified form.
Figure 11:
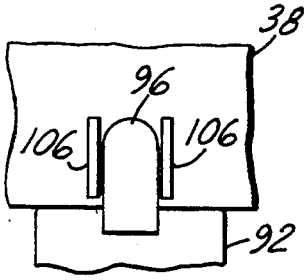
FIG. 11 is a view similar to FIG. 4 showing a fourth modified form.
Figure 12:
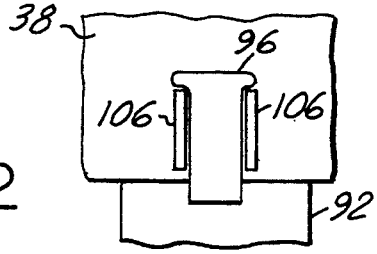
FIG. 12 is a view similar to FIG. 4 showing a fifth modified form.

It is possible that an OEM will specify that only one of these two functions be performed. Where only a circumferential orientation function is specified, portion 98 may be omitted from the clip, with self-retention of the clip being performed by portion 94 or some other means. Where the clip is only to prevent retraction of connector tube 72, portion 96 may be omitted, as in the clip shown in FIG. 8. FIGS. 10, 11, and 12 show other forms of circumferential locators between the clip and fuel rail, and they may also include axial locator capability.

Figure 13:
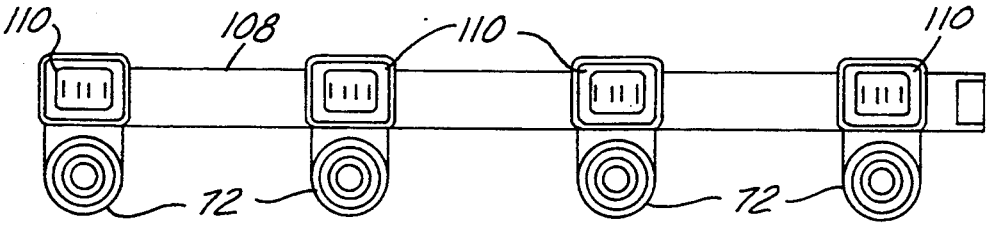
FIG. 13 is a bottom plan view showing a sixth modified form.

After fuel injectors have been installed, their connectors 66 must be connected with corresponding matching connectors leading to fuel injector control circuits. FIGS. 13–15 show an electrical connector bar 108 having a corresponding connector 110 for connection to the connector 66 of each fuel injector. The connector bar is joined to the connector tubes 72 for each fuel injector so that the connectors 110 and connector tubes 72 for all fuel injectors will retract and extend in unison. It is also possible for each connector 110 to be joined to its corresponding connector tube 72 without being connected to other connectors 110 by a connector bar so that the connector tube 72 and the connector 110 for each fuel injector can be extended and retracted in unison independently of the connector 110 and connector tube 72 for any other fuel injector. It is also possible that the connector bar may not be joined to any of the connector tubes 72, and where such a connector bar is rigid, it can serve as a circumferential location for the individual fuel injectors with regard to the respective fuel injection ports. By also providing for the connector bar with features that engage the connector tubes, a more rigid installation may be achieved.

Available space may impose restriction on the size and shape of a system. The remaining Figs. show various means for accommodating such restrictions through different shaped connector tubes, not all of which necessarily telescope in the manner of the previous Figs. FIGS. 16–18 disclose a connector tube 72 that has a 90 degree bend intermediate its ends. Its smaller diameter portion comprises an external flange 111 that fits within supply port 70 to cooperate with an internal shoulder of the supply port in capturing the O-ring seal 80. Just beyond flange in the direction of the supply port opening are several slots 112 in the sidewall of supply port 70. A U-shaped retainer clip 114 fits into these slots to provide an interference with flange that keeps the connector tube telescoped within the supply port, preventing its removal. This joint between the fuel supply port and the connecting tube is advantageous because it allows the fuel supply port to be fabricated without the use of consumable core process and the resulting supply port to have no parting lines on the surface that comes in contact with the O-ring seal. The larger diameter end has tabs 115 with which a clip (not shown) may be engaged to hold this end engaged with the fuel injector's inlet connector tube.

Figure 20:
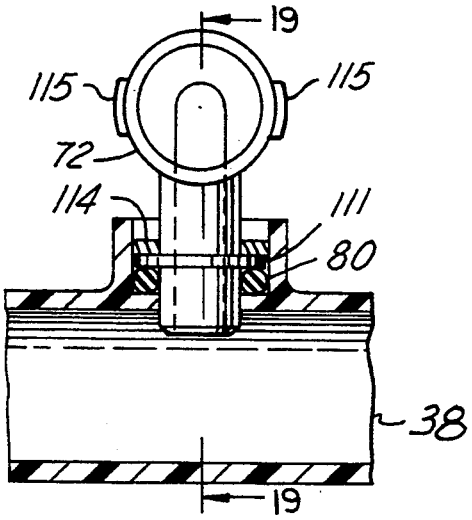
FIG. 20 is a cross-sectional view taken in the direction of arrows 20—20 in FIG. 19.
Figure 19:
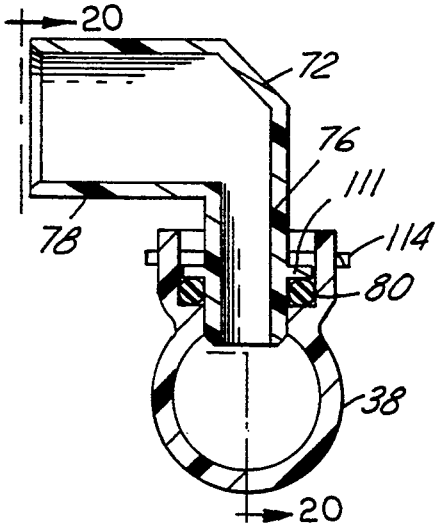
FIG. 19 is a view showing an eighth modified form, and is taken in the direction of arrows 19—19 in FIG. 20.

FIGS. 19 and 20 disclose an embodiment that differs from that of FIGS. 16–18 only in the details of the flange and its fit to the supply port.

Figure 21:
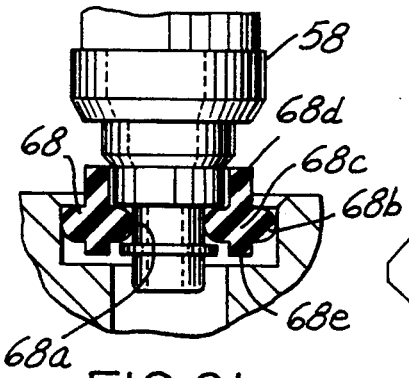
FIG. 21 is a cross-sectional view showing a ninth modified form.

FIG. 21 shows an alternate embodiment of seal 68 in which the radial cross section of the seal body comprises a semi-circular I.D. portion 68*a*, a semi-circular O.D. portion 68*b*, and a radially intermediate portion 68*c* joining portions 68*a* and 68*b*. This gives the seal body a greater radial extent than when it is only circular in cross section. The radially intermediate portion 68*c* comprises an axial rim 68*d*, 68*e* that projects axially to both sides. This seal provides more compliance for mounting the nozzle of a fuel injector in an injection port. The rim portion 68*e* limits the insertion depth of the seal while the rim portion 68*d* receives a portion of the nozzle end just above the groove that receives the seal. While the seal of FIG. 21 may be used for any embodiment, it is especially useful for those like FIGS. 16–20 and 22–24.

Figure 22:
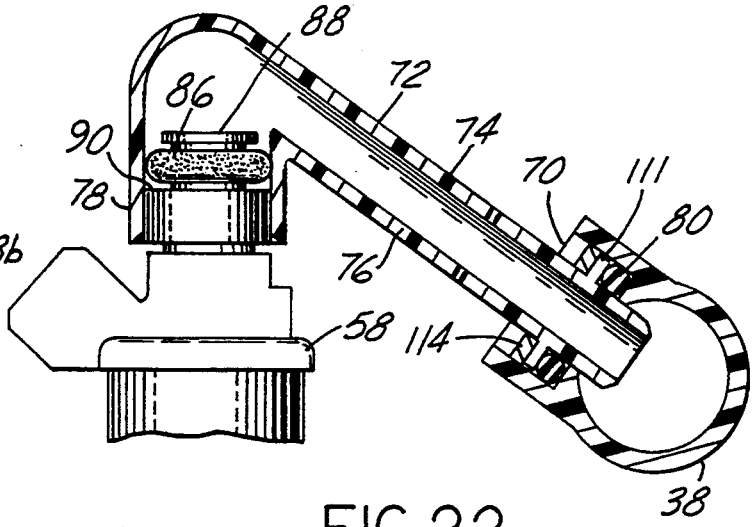
FIG. 22 is a view in the same direction as FIG. 2 showing a tenth modified form.

FIG. 22 shows an embodiment in which the fuel rail is disposed at a level vertically below that of the entrance of the fuel injector inlet tube. Here the bend in the connector tube 72 is much greater than 90 degrees. Although not specifically shown, there is a clip that is used for keeping the connector tube in engagement with the fuel injector inlet.

Figure 23:
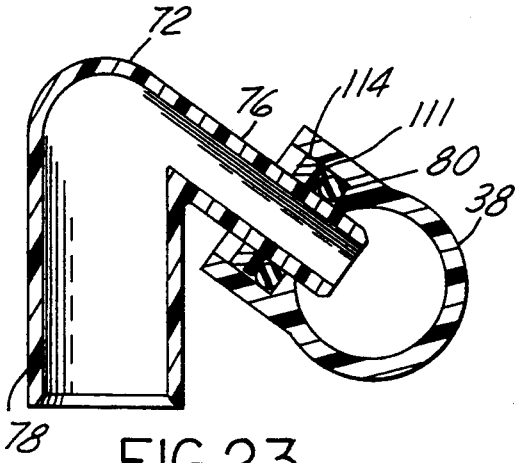
FIG. 23 is a view in the same direction as FIG. 2 showing an eleventh modified form.

FIG. 23 shows an embodiment similar to that of FIG. 22, but where the smaller diameter portion 76 of connector tube 72 is shorter and the larger diameter portion 78 is longer.

Figure 24:
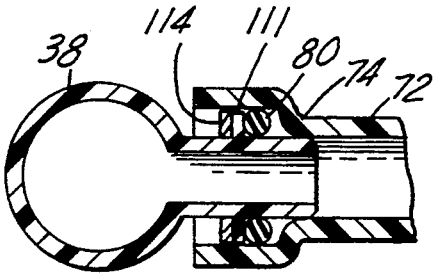
FIG. 24 is a view showing a twelfth modified form.

FIG. 24 shows an embodiment where the connector tube 72 telescopes over the outside of fuel supply port 70.

In the embodiments of FIGS. 22–24, the connector tube 72 may be essentially simultaneously telescopically engaged with the fuel supply port and the fuel injector inlet by pushing it downwardly into engagement with both.

Generally speaking, the various forms of fluid-tight joints between the rigid connector tube 72 and the fuel supply port 70 that have been disclosed herein may be used in various embodiments employing such connector tubes.

While a presently preferred embodiment of the invention has been illustrated and described, it should be appreciated that principles are applicable to other embodiments.

What is claimed is:

1. An integrated air-fuel system for an internal combustion engine comprising an induction air passage via which such an engine inducts air to a combustion chamber space thereof, a fuel rail including at least one electrically operated fuel injector via which fuel is injected into said induction air passage, wherein said fuel injector comprises an inlet that is communicated with a fuel supply port of said fuel rail and an outlet that is communicated with a fuel injection port of said induction air passage, said fuel supply port and said fuel injection port being in fixed spatial relation to each other that precludes their re-positioning to any other spatial relation, characterized in that said fuel supply port and said fuel injection port are spaced apart a fixed distance that is greater than the distance between the fuel injector's inlet and outlet, and the connection of said fuel injector with said ports is established by means which includes a tube that is telescopically engaged with one of said ports via a first fluid-tight joint for selective positioning between a first position that allows said fuel injector to be disposed between said tube and the other of said ports for installation and removal of the fuel injector and to a second position that captures the fuel injector in installed position between said tube and said other of said ports, including a second fluid-tight joint between the installed fuel injector and said tube and a third fluid-tight joint between the installed fuel injector and said other of said ports.

2. An integrated air-fuel system as set forth in claim 1 in which said one port is said fuel supply port of said fuel rail.

3. An integrated air-fuel system as set forth in claim 2 in which said first fluid-tight joint comprises an O-ring seal and means capturing said O-ring seal on said fuel supply port.

4. An integrated air-fuel system as set forth in claim 3 in which said tube comprises a shoulder that divides said tube into a smaller diameter portion telescopically engaged via said first fluid-tight joint with said fuel supply port and a larger diameter portion telescopically engaged via said second fluid-tight joint with said inlet of said fuel injector.

5. An integrated air-fuel system as set forth in claim 1 further including means that, when said tube is in its second position, provides between said fuel injector and the one of said fuel rail and said induction air passage that contains said one port, an interference that prevents separation of said fuel injector from said other port.

6. An integrated air-fuel system as set forth in claim 5 in which said interference is provided by a clip that is separably engaged with said fuel injector and with said one of said fuel rail and said induction air passage that contains said one port.

7. An integrated air-fuel system as set forth in claim 6 further including keying means effective between said fuel injector and said one of said fuel rail and said induction air passage that contains said one port for orienting said fuel injector in a desired orientation relative to said ports.

8. An integrated air-fuel system as set forth in claim 1 further including means that, when said tube is in its second position, provides between said tube and the one of said fuel rail and said induction air passage that contains said one port, an interference that prevents separation of said fuel injector from said other port.

9. An integrated air-fuel system as set forth in claim 8 in which said interference is provided by a clip that is separably engaged with said tube and with said one of said fuel rail and said induction air passage that contains said one port.

10. An integrated air-fuel system as set forth in claim 8 in which said clip also separably engages said fuel injector and further including keying means effective between said fuel injector and said one of said fuel rail and said induction air passage that contains said one port for orienting said fuel injector in a desired orientation relative to said ports.

11. An integrated air-fuel system as set forth in claim 1 in which said one port is said fuel supply port of said fuel rail and further including electrical connector means that is disposed on said tube and is electrically connected with a matching electrical connector means on said fuel injector when said tube is in its second position and that is electrically disconnected from said matching electrical connector means on said fuel injector when said tube is in its first position.

12. An integrated air-fuel system for an internal combustion engine comprising an induction air passage via which such an engine inducts air to a combustion chamber space thereof, a fuel rail including at least one electrically operated fuel injector via which fuel is injected into said induction air passage, wherein said fuel injector comprises an inlet that is communicated with a fuel supply port of said fuel rail and an outlet that is communicated with a fuel injection port of said induction air passage, said fuel supply port and said fuel injection port being in fixed spatial relation to each other that precludes their relative re-positioning to any other spatial relation, characterized in that between the fuel injector's inlet and said fuel supply port there is a separate rigid tube through which fuel is conveyed from said fuel supply port to said fuel injector's inlet, said tube has telescopic engagement with said fuel supply port via a first fluid-tight joint comprising a first O-ring seal and said tube has telescopic engagement with said fuel injector's inlet via a second fluid-tight joint comprising a second O-ring seal.

13. An integrated air-fuel system as set forth in claim 12 further including a third fluid-tight joint between said fuel injector's outlet and said fuel injection port of said induction air passage.

14. An integrated air-fuel system as set forth in claim 12 in which said fuel supply port and said fuel injection port are other than co-axially aligned, and said tube comprises at least one bend that is intermediate the tube's telescopic engagements with said fuel supply port and said fuel injector inlet.

15. An integrated air-fuel system as set forth in claim 14 in which said bend is at least a 90 degree bend.

16. An integrated air-fuel system as set forth in claim 15 in which said bend is greater than a 90 degree bend and is located nearer the tube's telescopic engagement with said fuel injector than the tube's telescopic engagement with said fuel supply port.

17. An integrated air-fuel system as set forth in claim 15 in which second fluid-tight joint comprises retention clip means for retaining said tube in engagement with said fuel injector.

18. An integrated air-fuel system as set forth in claim 14 further including a third fluid-tight joint comprising a third O-ring seal between said fuel injector's outlet and said fuel injection port of said induction air passage, said third O-ring seal comprising in radial cross section a body having a semi-circular I.D. portion, a semi-circular O.D. portion, and an intermediate portion joining said semi-circular I.D. and O.D. portions so as to render said semi-circular I.D. and O.D. portions non-concentric.

19. An integrated air-fuel system as set forth in claim 17 in which said intermediate portion of said third O-ring seal's body comprises annular rim structure protruding axially of both said semi-circular I.D. and O.D. portions.

20. An integrated air-fuel system as set forth in claim 12 in which the telescopic engagement of said tube with said fuel supply port comprises said tube being telescoped within said fuel supply port, said tube comprises flange means disposed to one axial side of said first O-ring seal, and retention clip means separably mounts on said fuel supply port to maintain said tube telescoped within said fuel supply port.

21. An integrated air-fuel system as set forth in claim 20 in which said retention clip means is disposed in aperture means in a sidewall of said fuel supply port axially beyond said flange means relative to said first O-ring seal to have an interference with said flange means to maintain said tube telescoped within said fuel supply port.

22. An air-fuel system for an internal combustion engine comprising an induction air passage via which such an engine inducts air to a combustion chamber space thereof, a fuel rail including at least one electrically operated fuel injector via which fuel is injected into said induction air passage, wherein said fuel injector comprises an inlet that is fluid-connected with a fuel supply port of said fuel rail and an outlet that is fluid-connected with a fuel injection port of said induction air passage, characterized in that the fluid-connection of said fuel injector's inlet with said fuel supply port comprises a fluid-tight joint that comprises an O-ring seal that is axially captured on said fuel supply port between spaced apart shoulders of said fuel outlet port, in which the fluid-connection of said fuel injector's inlet with said fuel supply port comprises and the fluid-connection of said fuel injector's inlet with said fuel supply port comprises a separate rigid tube having one end that is telescopically engaged with said fuel supply port and another end that is telescopically engaged with said fuel injector's inlet, the O.D. of said one end of said separate tube having sealing contact with the I.D. of said O-ring seal.

23. An air-fuel system for an internal combustion engine comprising an induction air passage via which such an engine inducts air to a combustion chamber space thereof, a fuel rail including at least one electrically operated fuel injector via which fuel is injected into said induction air passage, wherein said fuel injector comprises an inlet that is communicated with a fuel supply port of said fuel rail and an outlet that is communicated with a fuel injection port of said induction air passage, characterized in that between the fuel injector's inlet and said fuel supply port there is a separate rigid tube through which fuel is conveyed from said fuel supply port to said fuel injector's inlet, said tube has telescopic engagement with said fuel supply port via a first fluid-tight joint comprising a first O-ring seal and said tube has telescopic engagement with said fuel injector's inlet via a second fluid-tight joint comprising a second O-ring seal.

24. An air-fuel system as set forth in claim 23 in which said fuel supply port and said fuel injection port are other than co-axially aligned, and said tube comprises at least one bend that is intermediate the tube's telescopic engagements with said fuel supply port and said fuel injector's inlet.

25. An air-fuel system as set forth in claim 24 in which said bend is at least a 90 degree bend.

26. An air-fuel system as set forth in claim 24 in which said bend is greater than a 90 degree bend and is located nearer the tube's telescopic engagement with said fuel injector's inlet than the tube's telescopic engagement with said fuel supply port.

27. An assembly method for an air-fuel system for an internal combustion engine comprising an induction air passage via which such an engine inducts air to a combustion chamber space thereof, a fuel rail including at least one electrically operated fuel injector via which fuel is injected into said induction air passage, wherein said fuel injector comprises an inlet that is communicated with a fuel supply port of said fuel rail and an outlet that is communicated with a fuel injection port of said induction air passage, characterized by telescopically connecting one end of a separate rigid tube with said fuel supply port by means of a first fluid-tight joint comprising a first O-ring seal and telescopically connecting another end of the tube with said fuel supply port by means of a second fluid-tight joint comprising a second O-ring seal.

28. An assembly method as set forth in claim 27 in which said telescopic connections are made essentially simultaneously during the assembly method.

29. An assembly method as set forth in claim 27 in which electrical connection of an electric connector of said fuel injector to a matching electric connector from a source of fuel injector control signals for operating the fuel injector is made essentially simultaneously with the telescopic engagement of said fuel injector inlet with said fuel supply port.

* * * * *